US008333559B2

(12) United States Patent
Bushnell

(10) Patent No.: US 8,333,559 B2
(45) Date of Patent: Dec. 18, 2012

(54) OUTLET GUIDE VANES FOR AXIAL FLOW FANS

(75) Inventor: Peter R. Bushnell, Cazenovia, NY (US)

(73) Assignee: Carrier Corporation, Farmington, CT (US)

( * ) Notice: Subject to any disclaimer, the term of this patent is extended or adjusted under 35 U.S.C. 154(b) by 655 days.

(21) Appl. No.: 12/594,260

(22) PCT Filed: Apr. 3, 2007

(86) PCT No.: PCT/US2007/008073

§ 371 (c)(1),
(2), (4) Date: Oct. 1, 2009

(87) PCT Pub. No.: WO2008/123846

PCT Pub. Date: Oct. 16, 2008

(65) Prior Publication Data

US 2010/0119366 A1 May 13, 2010

(51) Int. Cl.
*F01D 9/00* (2006.01)

(52) U.S. Cl. ..... 415/211.2

(58) Field of Classification Search ..... 415/192, 415/211.2

See application file for complete search history.

(56) References Cited

U.S. PATENT DOCUMENTS 2,029,813 A 2/1936 De Mey
2,154,313 A 4/1939 McMahan
2,795,373 A 6/1957 Hewson
5,088,892 A 2/1992 Weingold et al.
5,466,120 A 11/1995 Takeuchi et al.
5,569,019 A 10/1996 Katariya et al.
5,988,980 A 11/1999 Busbey et al.
6,312,219 B1 11/2001 Wood et al.
6,328,533 B1 12/2001 Decker et al.
6,508,630 B2 1/2003 Liu et al.
6,554,564 B1 4/2003 Lord
7,101,145 B2 9/2006 Tsuchiya et al.
7,832,981 B2 * 11/2010 Hasan et al. ..... 415/211.2

OTHER PUBLICATIONS

International Search Report and Written Opinion mailed Jul. 28, 2008 (9 pgs.).
International Preliminary Report on Patentability mailed Oct. 15, 2009 (6 pgs.).

* cited by examiner

*Primary Examiner* — Richard Edgar
(74) *Attorney, Agent, or Firm* — Cantor Colburn LLP

(57) ABSTRACT

An outlet guide vane system is disclosed for axial flow fans. Construction details are described which reduce losses in the end wall regions of the vanes, particularly for axial flow fans operating at low flow coefficient with strong localized swirl associated with upstream rotor tip clearance flows. In the preferred embodiment, the vane spanwise airfoil stacking line is approximately straight, while leaning circumferentially toward the incoming swirl flow over the majority of the radial span. The stacking line then curves abruptly in the opposite direction over the radially outboard spanwise portion, so as to lean away from the incoming swirl at the vane tip station. The radially outboard portion of the vanes simultaneously include a gradual increase in vane stagger angle, vane camber angle and vane chord. The vane may also include an axial sweep component.

11 Claims, 3 Drawing Sheets

OUTLET GUIDE VANES FOR AXIAL FLOW FANS

BACKGROUND OF THE INVENTION

This invention relates generally to fans for moving air and, more particularly, to an improved outlet guide vane design for axial flow fans.

Axial flow fans are used in a wide range of applications, including HVAC, refrigeration, automotive, power systems and aerospace. Important considerations for these applications include efficiency, noise level, operating range, compactness, reliability and cost.

High performance axial flow fans typically utilize stationary outlet guide vanes to recover swirl flow generated by the upstream fan blades. This recovery process involves the transformation of swirl kinetic energy into increased static pressure across the guide vanes, and leads to significant improvement in efficiency. To achieve effective performance, care must be taken to design the vanes to be well aligned with the oncoming swirl and to ensure that they are able to turn the flow back to the axial direction with minimal total pressure loss.

The outlet guide vanes in this type of fan extend spanwise from inner to outer casing walls. Several equally spaced vanes are normally used; each is generally identical in shape and cambered to have a concave pressure surface and a convex suction surface. Each of those surfaces extends between the vane leading and trailing edges. The vanes are typically defined by generating a series of airfoil profiles along a spanwise stacking line. The various profiles may vary in thickness, camber and chord length, and the spanwise stacking line may take a variety of forms including those with bowed shapes, circumferential lean and axial sweep.

It is common practice to design the guide vanes so as to properly address the specific localized flows associated with a particular fan design. That is, vanes are generally optimized for spanwise flow variations by collectively varying the vane twist, camber and chord parameters. In addition, the vanes may be leaned in the circumferential direction or swept axially to "de-phase" the interaction of the fan blade wakes with the guide vanes, resulting reduced noise level.

In addition, a variety of methods for reducing total pressure losses associated with vane end-wall effects have been invented. These methods have been generally intended for use in the multi-stage compression section of gas turbine engines. One related concept is that shown in U.S. Pat. No. 2,795,373 issued to Hewson et. al., entitled "Guide Vane Assemblies In Annular Fluid Ducts." That patent proposes to reduce vane end-wall losses by using vanes having a curved stacking line or a stacking line composed of two angled sections that meet at the vane mid-span station.

Another technique is described in U.S. Pat. No. 5,088,892 issued to Weingold et. al., entitled "Bowed Airfoil for the Compression Section of a Rotary Machine." That patent shows an airfoil wherein the spanwise stacking line is straight over the mid-section of the airfoil and angled circumferentially in the end wall regions. The intent is similar to Hewson in managing vane losses in the vicinity of the end walls, but with a stiffer and lighter vane design.

Of particular interest in the present invention is the strong swirl flow that is produced in the clearance region between the fan blade tips and the casing wall. This localized swirl is especially important in fans with low ratio of axial flow velocity relative to blade tip speed (low flow coefficient), and can produce excessive loading and flow separation in the outboard stations of the stator vanes. Use of conventional guide vane design in such cases produces reduced fan efficiency and limitations in operating range.

The applicant has found that variations beyond the above art can be made to obtain further improvements in controlling the flow separation in axial flow fan outlet guide vanes, particularly for fans operating at low flow coefficients. These improvements have been developed by performing three-dimensional computational fluid dynamic analysis on an extensive series of fan rotor and vane design combinations. The performance benefits and vane stall properties have also been verified experimentally.

SUMMARY OF THE INVENTION

Briefly, in accordance with one aspect of the invention, in addition to the parameters discussed hereinabove, vane circumferential lean is selectively varied in order to provide improved vane flow separation control in the end wall regions.

By another aspect of the invention, the vanes are leaned in the circumferential direction toward the incoming swirl flow at an approximately constant angle over most of their radially inboard span portion and then are abruptly leaned in the opposite direction over the radially outer span portion.

By another aspect of the invention, the radially inboard span portion comprises about 75% of the span and the radially outer span portion comprises about 25% of the span.

In one embodiment the vane stacking line is leaned circumferentially at an angle of 10 to 25 degrees relative to the radial direction in the inboard span portion. The vane stacking line then bows in the opposite direction at approximately 75% span and emanates at the tip station with an angle of 20 to 40 degrees relative to the radial direction.

In accordance with another aspect of the invention vane stagger angle and vane chord are locally increased over the outer one-fourth span portion. These features allow the stator vanes to address the strong localized swirl flow that originates in the clearance flow of the upstream rotor to thereby minimize flow losses within the vane system and maximize static pressure recovery.

In accordance with another aspect of the invention the vanes are swept in the axial direction in combination with the aforementioned features.

In accordance with another aspect of the invention the vanes are non-overlapping where they meet the inboard end-wall.

In the drawings as hereinafter described, a preferred embodiment is depicted; however, various other modifications and alternate constructions can be made thereto without departing from the spirit and scope of the invention.

DETAILED DESCRIPTION OF THE INVENTION

Figure 1:
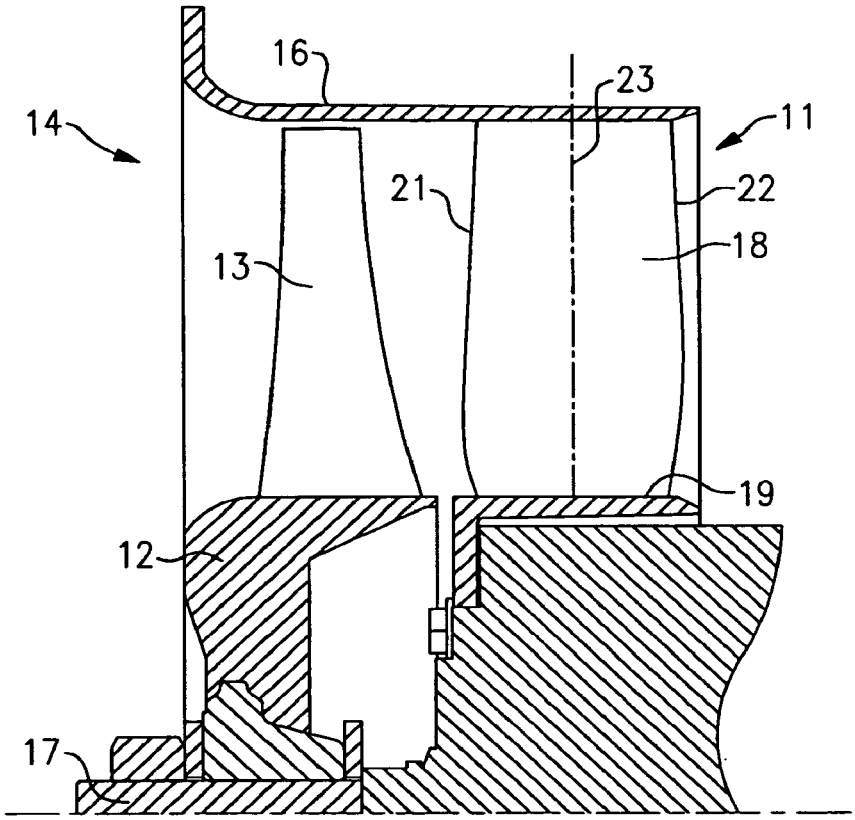
FIG. 1 is a sectional side view of an axial flow fan and outlet guide vane combination in accordance with the present invention.

An axial flow fan assembly is shown generally at 11 which includes a fan rotor 12 and a plurality of fan blades 13 attached to its outer periphery and extending radially outwardly into an opening 14 which is defined on its radially outer side by a casing 16. A drive motor 17 rotates the fan rotor 12 and its attached fan blades 13 to cause air to be drawn in and passed through the opening 14. Located downstream of the fan blades 13 is a plurality of outlet guide vanes 18 which are secured at their radially inner ends to an inner end wall 19 and at their radially outer ends to the casing 16 as shown. The outlet guide vanes 18 have a leading edge 21 and a trailing edge 22. The line 23 is drawn to connect the mid points between the leading edge 21 and 22 at constant radius stations, as indicated by the dashed lines, and is commonly known as the vane stacking axis. It should be recognized that the vane stacking axis 23 is linear and is orientated in the radial direction as shown.

As the fan blades 13 are rotated, the airflow moving toward the outlet guide vanes 18 has an axial component and a tangential component. It is the function of the outlet guide vanes 18 to remove the tangential component and, to the extent possible, to redirect it in the axial flow direction. While it is desirable to design the outlet guide vanes to be 100% efficient, i.e. to redirect all flow to the axial direction and have no swirl downstream of the inlet guide vanes, some swirl losses are inevitable. It is one purpose of the present invention to reduce the swirl losses particularly these in the vicinity of the casing 16 and inner end wall 19.

Figure 2A:
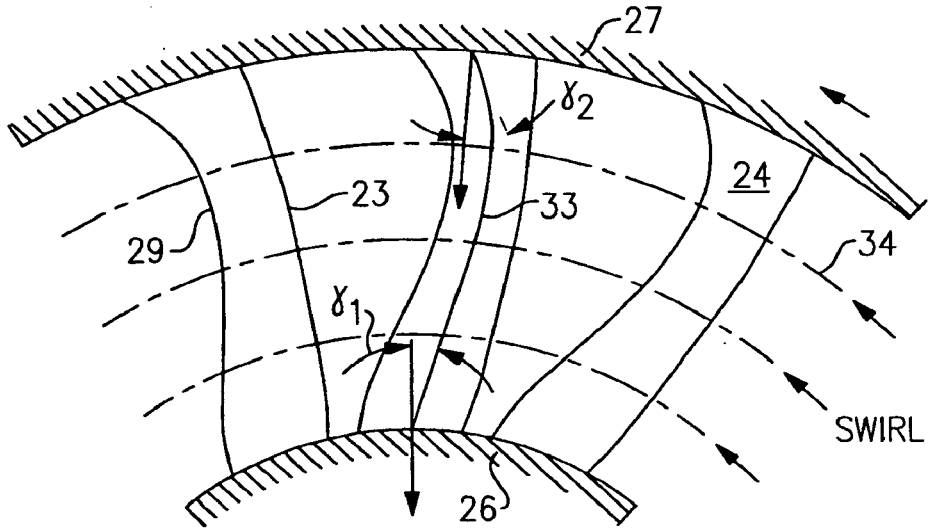
FIGS. 2A and 2B are respective rear axial and perspective views of outlet guide vanes in accordance with the present invention.
Figure 2B:
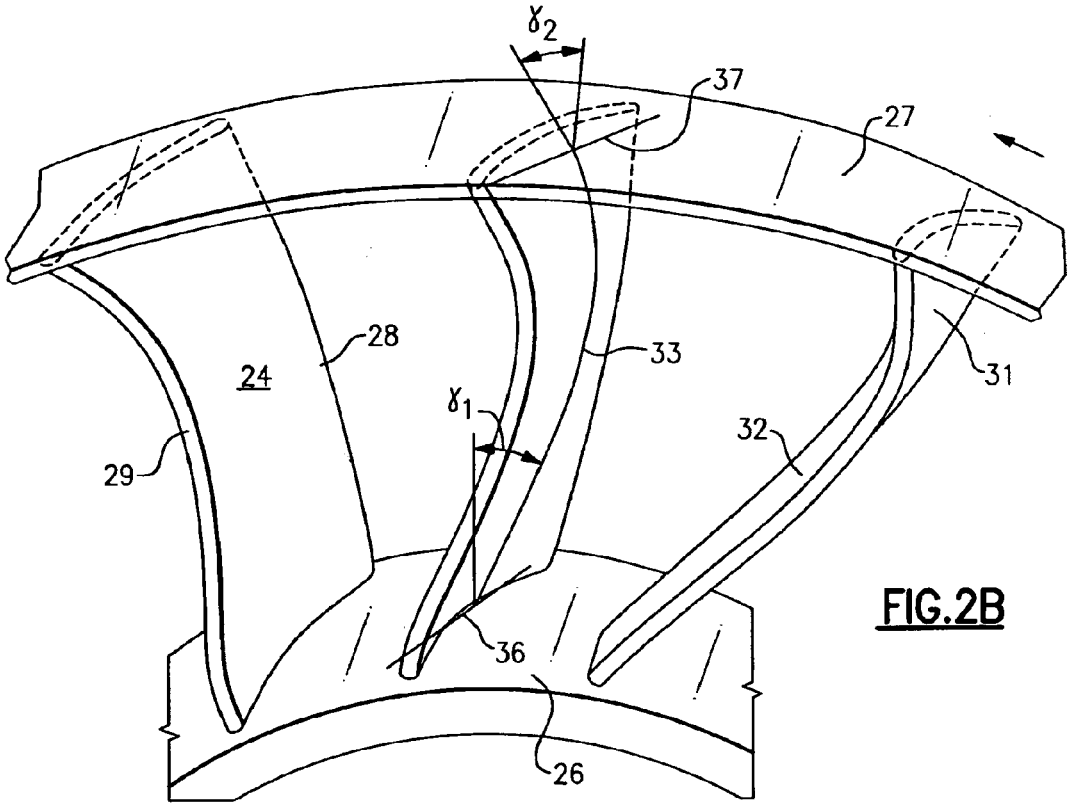

Referring now to FIGS. 2A and 2B, representative outlet guide vanes 24 are shown in accordance with the present invention. The outlet guide vanes 24 are integrally mounted to and extend generally radially between an inner end wall 26 and an outer end wall 27. The direction of the airflow is axially toward the viewer of FIGS. 2A and 2B, with the swirl being generally in the counterclockwise direction as shown by the arrows.

Each of the outlet guide vanes 24 has a leading edge 28 and a trailing edge 29 as well as a pressure side 31 and a suction side 32.

Each of the outlet guide vanes 24 has a vane stacking axis as defined hereinabove and as shown at line 33. It will be seen that the vane stacking axis 33 has a substantially constant lean angle $\gamma_1$ as it extends radially outward from the base with the lean being generally toward the incoming swirl. As will be seen, this substantially constant lean angle extends generally radially outward through about 75° of the span (i.e. to dashed line 34 in FIG. 2A). At that point, the vane stacking axis abruptly changes direction such that it leans generally away from the oncoming swirl for the remaining 25% of the radial span, i.e. on the radially outward portion thereof.

The applicants have found that exemplary values for $r_1$ are in the range of 10°-25°, whereas exemplary values for $r_2$ are in range of 20-40°. In this way, the applicants have found that with the use of vane circumferential lean as described, an improvement in vane flow separation control is obtained, particularly in the end wall regions.

Before considering other design features of the present invention, it should be recognized that the chord lines 36 and 37 at the respective radially inner and outer ends of the outlet guide vanes 24 are preferably at different angles. As background for further details, reference is made to FIG. 3 that shows a cross-section view of a vane airfoil profile for purposes of defining various features thereof. As discussed hereinabove, the airfoil 24 has a leading edge 21, a trailing edge 22, a pressure side 31 and a suction side 33. A chord line 38 is on a constant radius station which interconnects the leading edge 21 to the trailing edge 22. A mean camber line shown at 39 is a line extending from the leading edge 21 to the trailing edge 22 and passing through the midpoints between the pressure side 31 and the suction side 32.

Considering now the disposition of the airfoil within the airflow stream, the axis of the fan rotor, and the direction of the axial component of the airflow is shown by the dashed line 41, and the tangential direction is shown by the dashed line 42. The direction of the airflow coming from the fan is shown by the vector 43, with the axial component being represented by the vector 44 and the tangential component being represented by the vector 46.

Figure 3:
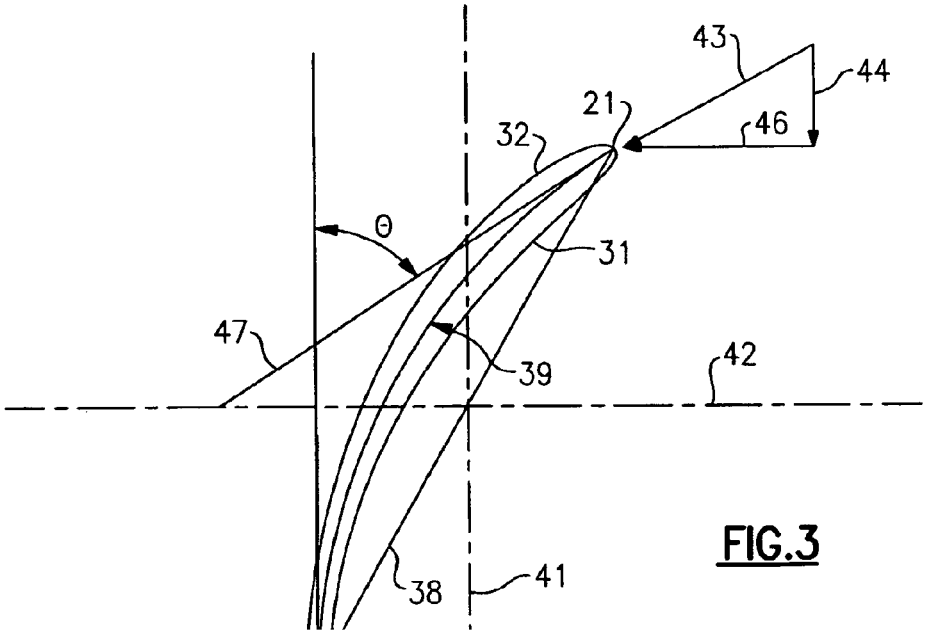
FIG. 3 is a sectional view of a vane airfoil profile in accordance with the present invention.

The stagger angle, which is that angle between the axis 41 and the chord line 38 is shown by the angle $\xi$, and the camber angle, which is the angle between the tangency line extending from the mean camber line at the vane leading and trailing edges, is represented by the angle $\theta$ in FIG. 3.

Having described the characteristics of the outlet guide vanes in respect to the vane stacking axis, further refinements can be made to the outlet guide vanes 24 with the above described definitions in mind. The applicant has found that improved performance will be obtained if the vane stagger angle and vane chord are locally increased over the outer ¼ span. Those features will allow the stator vanes to address the strong localized swirl flow that originates in the clearance flow of the upstream rotor to thereby minimize flow losses within the vane system and maximize static pressure recovery.

Figure 4:
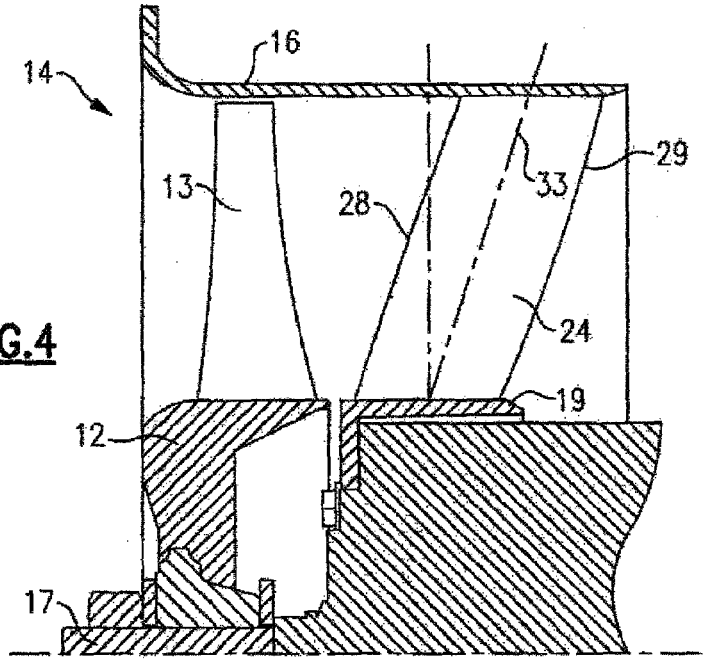
FIG. 4 is a side sectional view of an axial flow fan and outlet guide vane in accordance with the present invention.
Figure 5A:
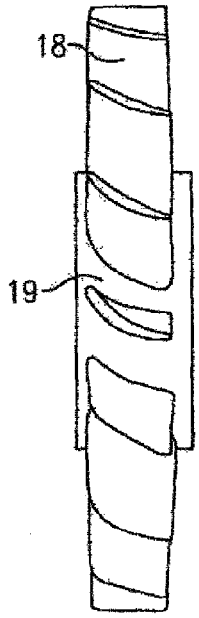
FIGS. 5A and 5B are side orthogonal views of outlet guide vanes in accordance with conventional and present invention designs, respectively.
Figure 5B:
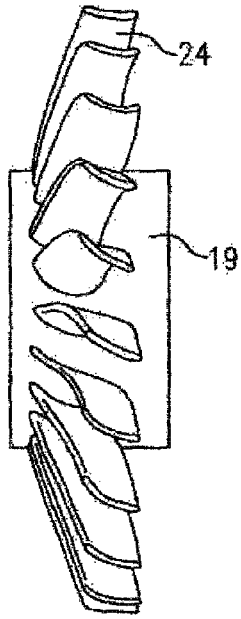

A further characteristic of the present invention is to obtain reduced fan noise. This is accomplished by incorporating an axial sweep component in the vane spanwise stacking line as shown in FIG. 4. The outlet guide vanes 24 are so disposed that their stacking axis utilizes the circumferential lean features described herein above while additionally their stacking axis is swept axially downstream. This is contrasted with the outlet guide vanes 18 shown in FIG. 5A wherein the vanes are disposed substantially in a plane normal to the fan rotational axis, rather than at a backswept angle as shown in FIG. 5B. This axially swept vane configuration produces a reduced level of rotor-stator interaction noise, while maintaining the aerodynamic advantages at the vane end-walls by coordination of the circumferential lean features of the present invention.

A further characteristic that is designed to improve performance is that of the outlet guide vanes 24 being non-overlapping where they meet the inboard end wall. This enables straight-pull tooling.

While the present invention has been particularly shown and described with reference to the particular exemplary embodiment as illustrated in the drawings, it will be understood by one skilled in the art that various modification or changes, some of which have been discussed herein, may be affected therein without departing from the sprit and scope of the invention.

I claim:

1. An axial fan outlet guide vane comprising:

pressure and suction surfaces, extending radially between inner and outer end walls and axially between leading and trailing edges;

a spanwise stacking line defining the three dimensional distribution of airfoil mid-chord points of said vane;

said stacking line originating at said inner end wall and being approximately straight, while leaning circumferentially toward the incoming swirl over the majority of the radial span, and forming the radially inner portion of said vane;

said stacking line being curved abruptly in the opposite direction over the radially outboard spanwise portion, so as to lean away from the incoming swirl;

wherein said radially outboard portion of said vane includes a gradual increase in vane stagger angle, vane camber angle, and vane chord.

2. An axial fan outlet guide vane set forth in claim 1 wherein said radially inner portion comprises approximately 75% of the vane span and the radially outer portion comprises approximately 25% span.

3. An axial fan outlet guide vane set forth in claim 1 wherein said inboard portion of vane stacking line is approximately straight, while angled so as to lean toward the incoming swirl in the circumferential direction with an angle between 10 and 25 degrees in relation to the radial direction.

4. An axial fan outlet guide vane set forth in claim 1 wherein said outboard portion of vane stacking line is curved in the circumferential direction wherein said stacking line at the vane tip station is angled between 20 and 40 degrees in relation the radial direction.

5. An axial fan outlet guide vane set forth in claim 1 where in said stacking line includes an axial sweep component with an average axial sweep angle between 10 and 45 degrees.

6. An axial flow fan system comprising:

a fan rotor having a plurality of rotor blades which, when rotated, transfer energy to the air producing a radially distributed combination of axial and tangential flow;

a plurality of outlet guide vanes, disposed downstream of said rotor, each consisting of pressure and suction surfaces, extending radially between inner and outer end walls and axially between leading and trailing edges;

a spanwise stacking line defining the three dimensional distribution of airfoil mid-chord points of each vane;

said stacking line originating at said inner end wall and being approximately straight, while leaning circumferentially toward the incoming swirl over the majority of the radial span, and forming the radially inner portion of each vane;

said stacking line being curved abruptly in the opposite direction over the radially outboard spanwise portion, so as to lean away from the incoming swirl at the vane tip station;

wherein said radially outboard portion of said vanes include a gradual increase in vane stagger angle, vane camber angle and vane chord.

7. A plurality of axial fan outlet guide vanes set forth in claim 6 wherein said radially inner portion comprises approximately 75% of the vane span and the radially outer portion comprises approximately 25% span.

8. A plurality of axial fan outlet guide vanes set forth in claim 6 wherein said inboard portion of vane stacking line is approximately straight, while angled so as to lean toward the incoming swirl in the circumferential direction with an angle between 10 and 25 degrees in relation to the radial direction.

9. A plurality of axial fan outlet guide vanes set forth in claim 6 wherein said outboard portion of vane stacking line is curved in the circumferential direction wherein said stacking line at the vane tip station is angled between 20 and 40 degrees in relation the radial direction.

10. A plurality of axial fan outlet guide vanes set forth in claim 6 where in said stacking line includes an axial sweep component with an average axial sweep angle between 10 and 45 degrees.

11. A plurality of axial fan outlet guide vanes set forth in claim 6 where in said vanes are non-overlapping when viewed in the axial direction.

* * * * *